US005535927A

United States Patent [19]

Garrison

[11] Patent Number: 5,535,927

[45] Date of Patent: Jul. 16, 1996

[54] NON-SLIP HANGER AND METHOD OF MANUFACTURE THEREOF

[75] Inventor: Judd F. Garrison, Grand Rapids, Mich.

[73] Assignee: Batts, Inc., Zeeland, Mich.

[21] Appl. No.: 253,820

[22] Filed: Jun. 3, 1994

Related U.S. Application Data

[63] Continuation of Ser. No. 805,235, Dec. 11, 1991.

[51] Int. Cl.[6] ..... A47G 25/14

[52] U.S. Cl. ..... 223/92; 223/85

[58] Field of Search ..... 223/92, 95, 88, 223/85; D6/315; 211/113

[56] References Cited

U.S. PATENT DOCUMENTS

| | | | |
|---|---|---|---|
| 1,320,445 | 8/1919 | Butrick . | |
| 1,321,997 | 11/1919 | Duberstein | 223/92 |
| 1,886,126 | 11/1932 | Sessions | 223/88 |
| 2,132,895 | 10/1938 | Fewster | 223/92 |
| 2,376,269 | 5/1945 | Pauli | 223/88 |
| 2,622,742 | 12/1952 | Oldham | 223/91 X |
| 2,835,442 | 5/1958 | Stuard | 223/92 |
| 2,875,930 | 3/1959 | Lerner . | |
| 2,912,149 | 11/1959 | Stuard | 223/92 |
| 2,981,451 | 4/1961 | Friedman . | |
| 3,085,724 | 4/1963 | Wilde . | |
| 3,168,970 | 2/1965 | Wilson | 223/92 |
| 3,257,049 | 6/1966 | Smith . | |
| 3,306,506 | 2/1967 | Batts . | |
| 3,358,891 | 12/1967 | Rowe | 223/88 |
| 3,480,245 | 11/1969 | Gingher . | |
| 3,679,100 | 7/1972 | Brorson et al. . | |
| 4,040,546 | 8/1977 | Liebscher et al. . | |
| 4,046,293 | 9/1977 | Garrison . | |
| 4,586,637 | 5/1986 | Lemel | 223/92 |
| 5,020,705 | 6/1991 | Garrison . | |
| 5,046,649 | 9/1991 | Hazenveld . | |
| 5,170,916 | 12/1992 | Kolton et al. . | |

FOREIGN PATENT DOCUMENTS

| | | | |
|---|---|---|---|
| 114130 | 8/1940 | Australia | 223/88 |
| 1258892 | 3/1961 | France | 223/88 |
| 1252386 | 10/1967 | Germany | 223/85 |

*Primary Examiner*—C. D. Crowder
*Assistant Examiner*—Bibhu Mohanty
*Attorney, Agent, or Firm*—Baker & McKenzie

[57] ABSTRACT

An improved garment hanger is provided with a coating of resilient friction material on the upper surfaces of the garment support members to provide non-slip surfaces for garments such as coats, shirts, blouses and dresses and help prevent the garments from falling off the garment hanger and onto the floor. The application of resilient friction material applies equally to pant bars. The improved resilient friction material comprising a block copolymer having discreet block segments of styrene monomer units and rubber monomer units.

9 Claims, 6 Drawing Sheets

10
11
12
13
13a
14
14a
15
16
17
18
4
5
6
7
8
9

13
14
21
22
23
24
25
26
27
31
32
33

NON-SLIP HANGER AND METHOD OF MANUFACTURE THEREOF

This application is a continuation of application Ser. No. 07/805,235, filed Dec. 11, 1991.

This invention relates generally to garment hangers and specifically to such hangers which include a resilient friction material attached to the upwardly facing surfaces of the garment hanger to provide a non-slip surface for receiving the garment and to prevent by friction, the garment from falling off the garment hanger.

BACKGROUND OF THE INVENTION

A common problem associated with today's garment hangers is that the garments slip off the hanger and fall to the floor. This problem is particularly annoying to a consumer who places a relatively expensive and fragile garment, such as a business suit, on a garment hanger with a fairly slippery upper surface. The slacks, skirt and/or coat often falls to the floor and becomes wrinkled, thereby requiring ironing or dry cleaning. It is also annoying to the manufacturers of garments who ship the completed garments on garment hangers to retail establishments only to have the garments fall off of the hangers during transit. By the same token, retailers are very particular about product presentation and will not tolerate garment hangers that permit the garments to fall to the floor.

There have been several attempts to remedy this situation. Specifically, garment hangers with upwardly protruding nipples, ridges, cleats or button-like projections are well known. However, none of these designs acceptably grips the garments because the various gripping means, such as cleats, are made from the same hard, slippery material used to fabricate the rest of the body of the garment hanger. The weight of the garment alone against the upward protrusions does not provide enough friction to keep the garment from falling on the floor. This is especially true with lightweight women's apparel; the downward force of lightweight garments on the garment hanger and/or gripping means does not provide enough friction to keep the lightweight garment from falling on the floor.

Yet another strategy to solve this problem has been to fabricate the gripping means or upward protrusions out of a resilient material, such as rubber, as opposed to the hard material used to fabricate the body of the garment hanger. This strategy suffers from the above-mentioned shortcomings too because conventional rubber is a fairly hard substance and does not grip lightweight garments well. The force of gravity on a lightweight garment does not generate enough friction between the garment and the conventional rubber gripping means to keep the garment from falling on the floor.

Hence, there is a need for a new garment hanger that will positively grip a garment under the garments' own weight. The hanger must be able to grip the garment without either marking or adhering to the garment fabric. Further, because the hanger must be capable of use as shipping hangers by clothing manufacturers, the hanger must be able to maintain its gripping ability under a wide range of temperatures and rough handling resulting from the shocks and bumps of which such hangers are exposed to during shipment. Finally, the dissimilar components of the hanger must be easily bonded to one another.

This invention provides a solution to all of the above-mentioned problems and satisfies all of the above criteria. The family of resilient materials identified provides positive gripping action for lightweight and heavyweight garments alike. The family of materials also provides excellent gripping ability in both cold and hot environments. The materials are smooth to the touch and do not mark the garments. Finally, they adhere easily to conventional plastic garment hangers.

BRIEF DESCRIPTION OF THE INVENTION

The improved garment hanger of the present invention includes a garment support member and optional pant bar arranged to receive and suspend a garment in contact with the upper surface of the garment support member. The garment support member includes a hang means, such as a hook, located at about the center of the garment support member. Resilient friction material is carried by the upper surfaces of the garment support member on either side of the hook and on the upper surface of the pant bar to provide up to three non-slip surfaces to receive the garment and pants and help prevent them from falling off the garment hanger and onto the floor. The ideal resilient friction material for this purpose has been found to be a block copolymer having discreet block segments of styrene monomer units and rubber monomer units.

The application of block copolymers having discreet block segments of styrene monomer units and rubber monomer units is ideal for garment hangers of all conventional designs. The use of a block copolymer having discreet block segments of styrene monomer units and rubber monomer units is not limited to the specific garment hanger embodiments described in the drawings.

BRIEF DESCRIPTION OF THE DRAWINGS

This invention is illustrated more or less diagrammatically in the accompanying drawings wherein.

DETAILED DESCRIPTION OF THE INVENTION

Figures 1, 2, 3:
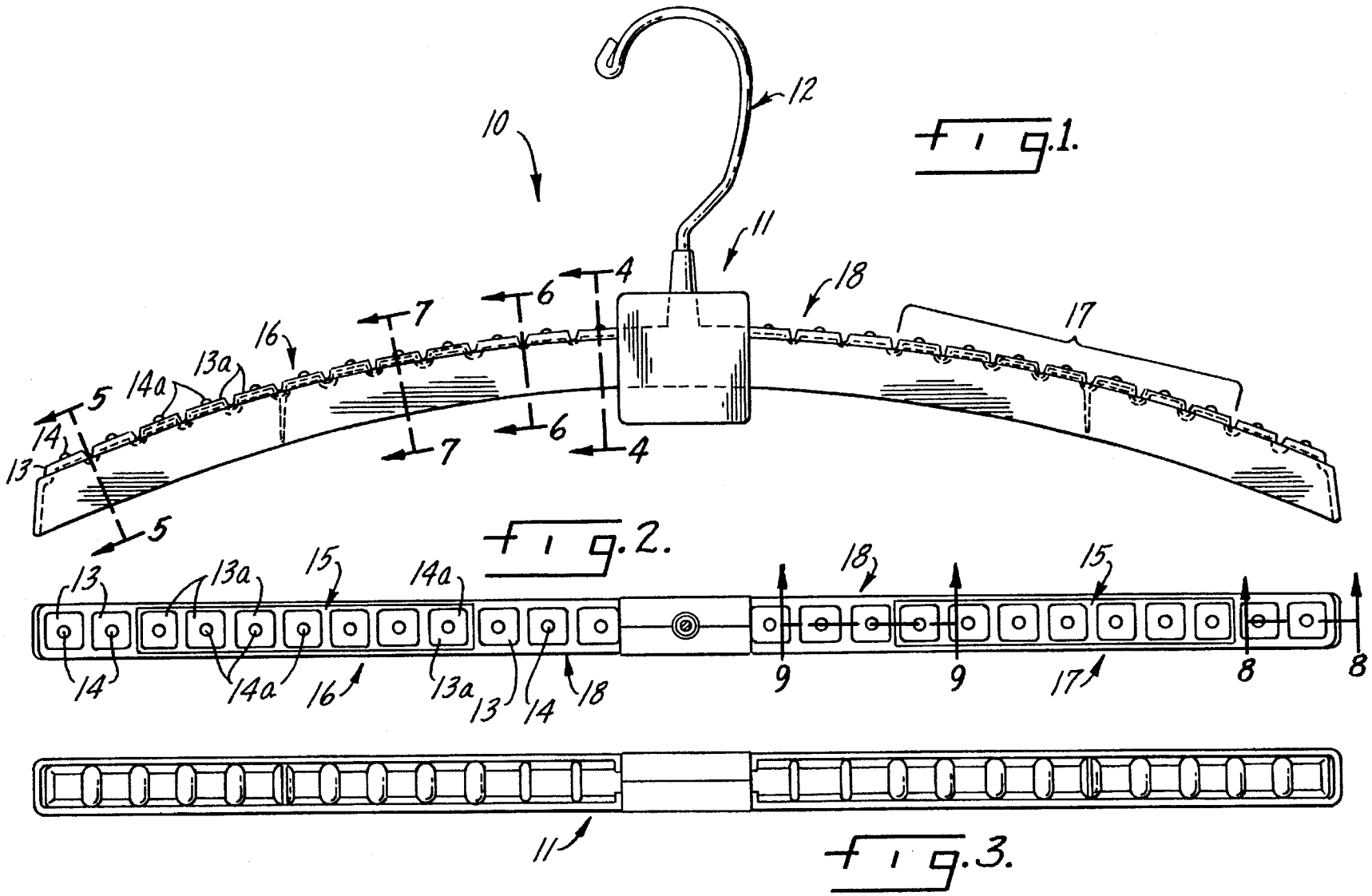
FIG. 1 is a front elevation of one embodiment of a garment hanger made in accordance with this invention.
FIG. 2 is a top plan view of the garment hanger depicted in FIG. 1.
FIG. 3 is a bottom plan view of the garment hanger depicted in FIG. 1.

Like reference numerals will be used to refer to like or similar parts from figure to figure in the following description of the drawings.

One garment hanger embodiment of this invention is illustrated at 10 in FIG. 1. The hanger consists of a main garment support section, indicated generally at 11. A suspending device, here a hook, is indicated generally at 12.

The main garment support section 11 is a one piece structure of arcuate form with a row of upwardly protruding cleats 13 running along either side of the hook 12. Each upwardly protruding cleat 13 includes an upwardly protruding nipple-like projection 14 located at about the center of the upwardly protruding cleat 13.

The improvement taught by the present invention lies in the addition of the special gripping sections 16, 17 which extend over, in this instance, the mid-portions of the series of cleats 13 on both sides of the hook 12. The gripping sections 16, 17 include an upper surface formed of a new resilient material, or family of resilient materials, on the modified upwardly protruding cleats 13a and nipples 14*a*, thereby drastically improving the garment gripping ability of the garment support member 11.

As will be seen from FIG. 2, the resilient material, indicated generally at 15, is not applied to all of the cleats 14 located along the entire garment support member 11. Rather the resilient material 15 is applied to discreet sections 16 and 17 of the rows of protruding cleats located on either side of the hook 12. The upwardly protruding cleats and nipples that are coated with the resilient material are indicated generally at 13*a* and 14*a* respectively while the uncoated cleats and nipples are indicated at 13 and 14 respectively. The sections of coated cleats 16 and 17 may extend to cover all cleats 13 and nipples 14 embodied in the garment support member 11 or may be shortened to cover only a few cleats 13*a* and nipples 14*a* on either side of the hook 12.

Figure 4:
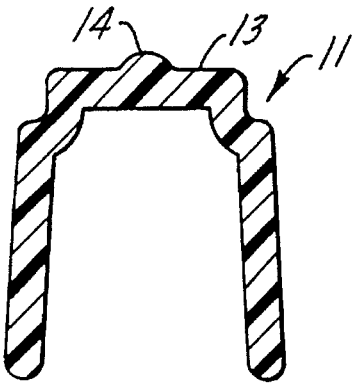
FIG. 4 is a section taken substantially along line 4—4 of FIG. 1.
Figure 5:
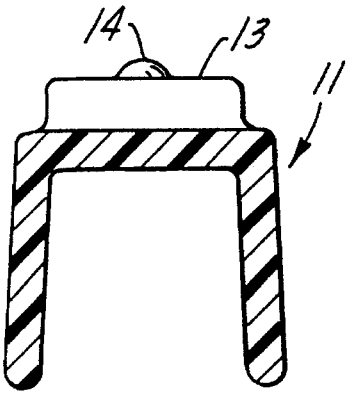
FIG. 5 is a section taken substantially along line 5—5 of FIG. 1.
Figure 6:
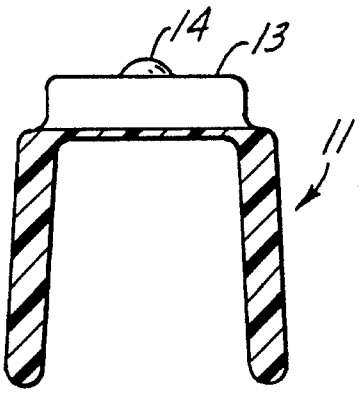
FIG. 6 is a section taken substantially along line 6—6 of FIG. 1.
Figure 7:
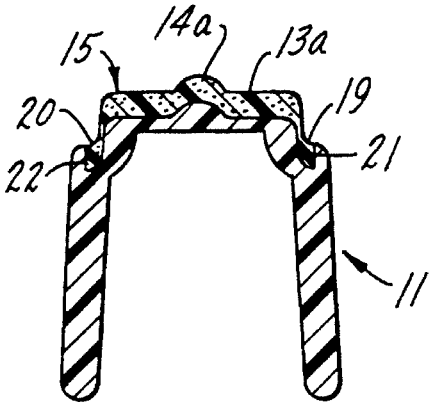
FIG. 7 is a section taken substantially along line 7—7 of FIG. 1.

FIGS. 4 through 9 illustrate, in detail, the cleat and nipple configuration of the FIG. 1 hanger. FIGS. 4, 5 and 6 show different sectional views of the uncoated cleats 13 and nipples 14. FIG. 7 is a sectional view of a coated cleat 13*a* and coated nipple 14*a*. Grooves 21 and 22 accommodate the outer edges 19, 20 of the strip of resilient material 15 and facilitate the adherence of the resilient material 15 to the garment support member 11 during the life of the garment hanger 10.

Figure 8:
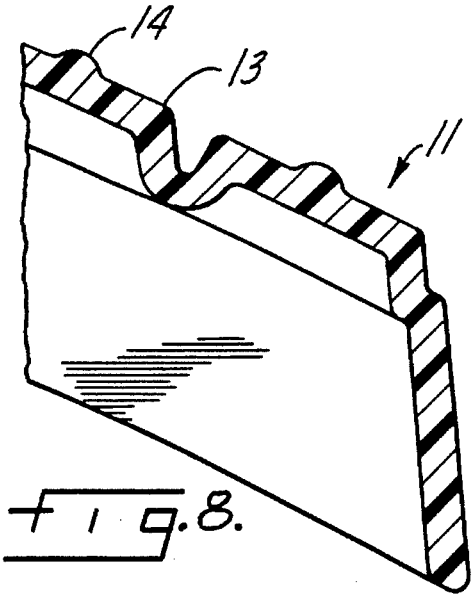
FIG. 8 is a section taken substantially along line 8—8 of FIG. 2.
Figure 9:
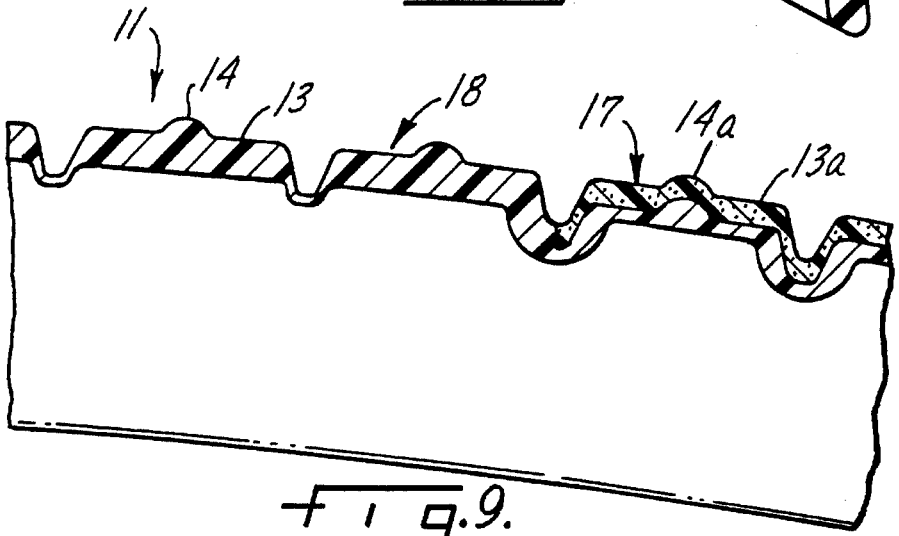
FIG. 9 is a section taken substantially along line 9—9 of FIG. 2.

FIG. 8 is a side view of an uncoated end portion of the garment hanger 10 of FIG. 1. FIG. 8 further illustrates uncoated nipples 14 and uncoated cleats 13. FIG. 9 is a side view of a mid-portion of the garment support member 11 of FIG. 1 and contrasts an uncoated section 18 of the garment support member 11 with the coated section 17.

Figures 10, 11, 12, 13:
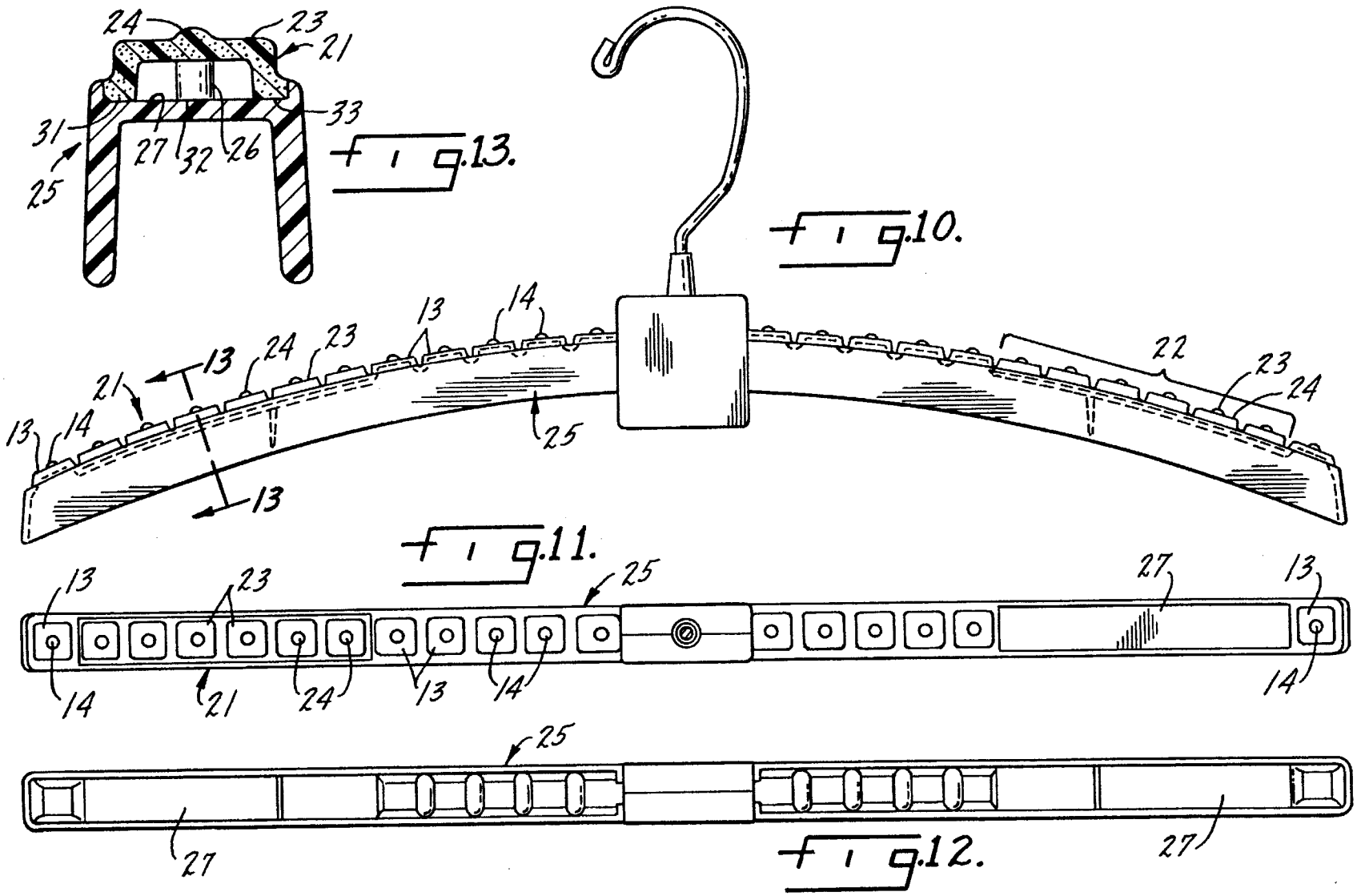
FIG. 10 is a front elevation of another embodiment of a garment hanger made in accordance with this invention.
FIG. 11 is a top plan view of the garment hanger of FIG. 10.
FIG. 12 is a bottom plan view of the garment hanger of FIG. 10.
FIG. 13 is a section taken substantially along line 13—13 of FIG. 10.

FIG. 10 is an alternative embodiment to the garment hanger depicted in FIG. 1. Specifically, the cleats 13 and nipples 14 are not coated with the resilient material of this invention. Rather, sections 21 and 22 are composed of preformed cleats 23 and pre-formed nipples 24 made from the resilient material. Sections 21 and 22 are then affixed to the garment support member 25 by conventional adhering means.

FIG. 13 is a cross-section of garment support member 25 with molded cleat and nipple section 21 adhered thereto. Cylindrical extension 26 extends down to abut the base of the groove 27 thereby providing an extra engagement point for securement. If desired, conventional adhesives may be applied to the groove 27 to provide lasting attachment securement at points 31, 32 and 33.

Figure 14:
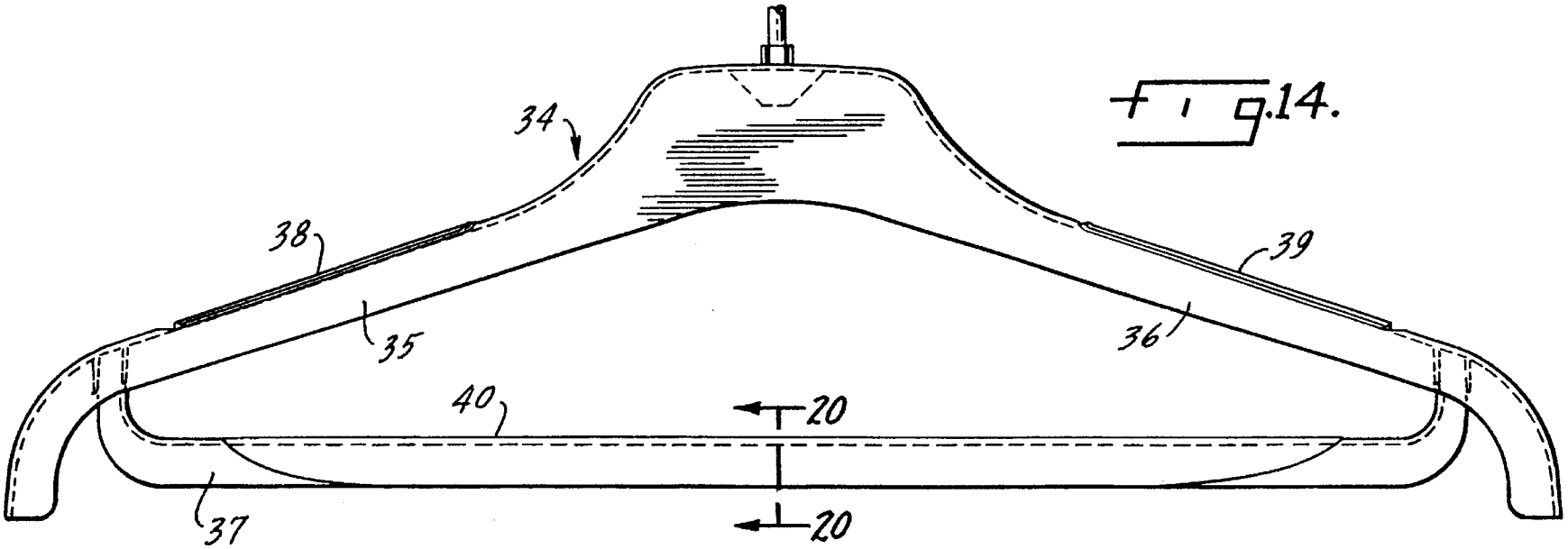
FIG. 14 is yet another embodiment of garment hanger made in accordance with this invention, in this instance, with a pant attachment.
Figure 15:
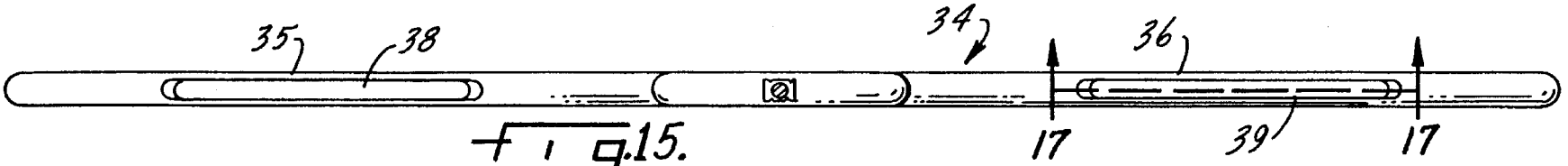
FIG. 15 is a top plan view of the garment hanger shown in FIG. 14.
Figure 16:
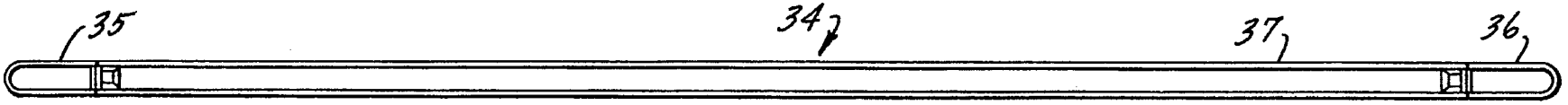
FIG. 16 is a bottom plan view of the garment hanger shown in FIG. 14.

Referring now to FIG. 14, the resilient material may also be coated on curved garment hangers 34 at the shoulder areas 35 and 36 as well as the pant or skirt bar 37. A relatively thin coating 38 or 39 applied to the shoulder areas 35 or 36 will insure that a jacket, blouse or dress will stay on the hanger 34 and not fall on the floor. Further, a thin coating 40 applied to pant bar 37 will keep the trousers on the pant bar 37 and off the floor.

Figure 17:
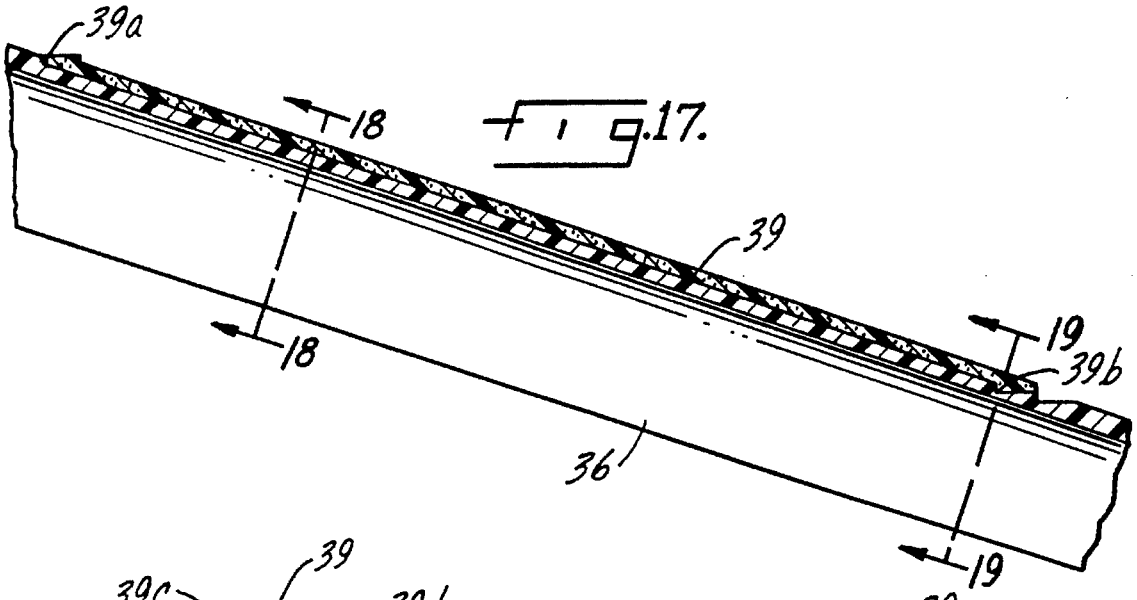
FIG. 17 is a section taken substantially along line 17—17 of FIG. 15.
Figure 18:
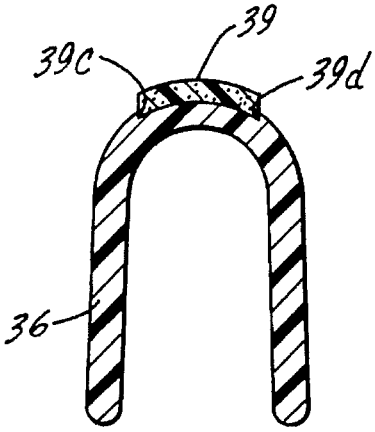
FIG. 18 is a section taken substantially along line 18—18 of FIG. 17.
Figure 19:
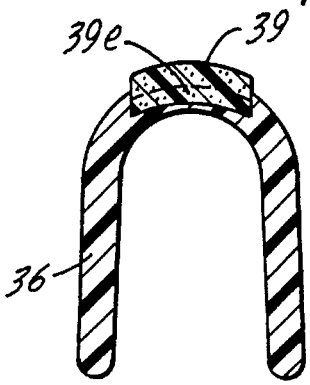
FIG. 19 is a section taken substantially along line 19—19 of FIG. 17.

FIG. 17 is a side view of shoulder area 36 illustrating the relative thickness of resilient material 39 to be applied to the shoulder area 36 and the structural securement between the resilient material 39 and the shoulder area 36 provided by recessed shoulders 39*a* and 39*b*. FIGS. 18 and 19 show the relative thicknesses of the resilient material 39 in the middle and at the end of the shoulder area 36 respectively and the additional structural securement derived from the abutment shoulders 39*c*, 39*d* and 39*e*.

Figure 20:
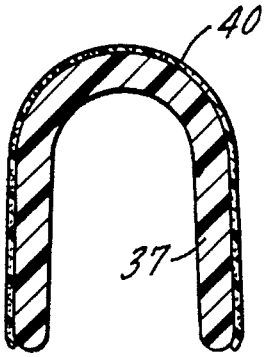
FIG. 20 is a section taken substantially along line 20—20 of FIG. 14.
Figure 21:
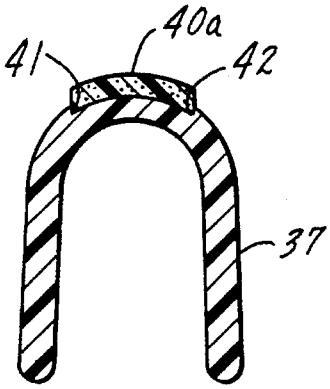
FIG. 21 is an alternative configuration to the sectional view shown in FIG. 20.

FIG. 20 illustrates a cross-section of the pant bar 37 with resilient material 40 applied thereto and provides an indication of the area of abutment of the resilient material 40 against the pant bar 37. FIG. 21 shows an alternative method of attaching the resilient material 40*a* to the pant bar 37 that is analogous to the method shown in FIGS. 18 and 19. The pant bar 37 may include a groove including abutment shoulders 41 and 42 to provide structural securement of the resilient material 40*a*.

Figures 22, 23, 24, 25, 26:
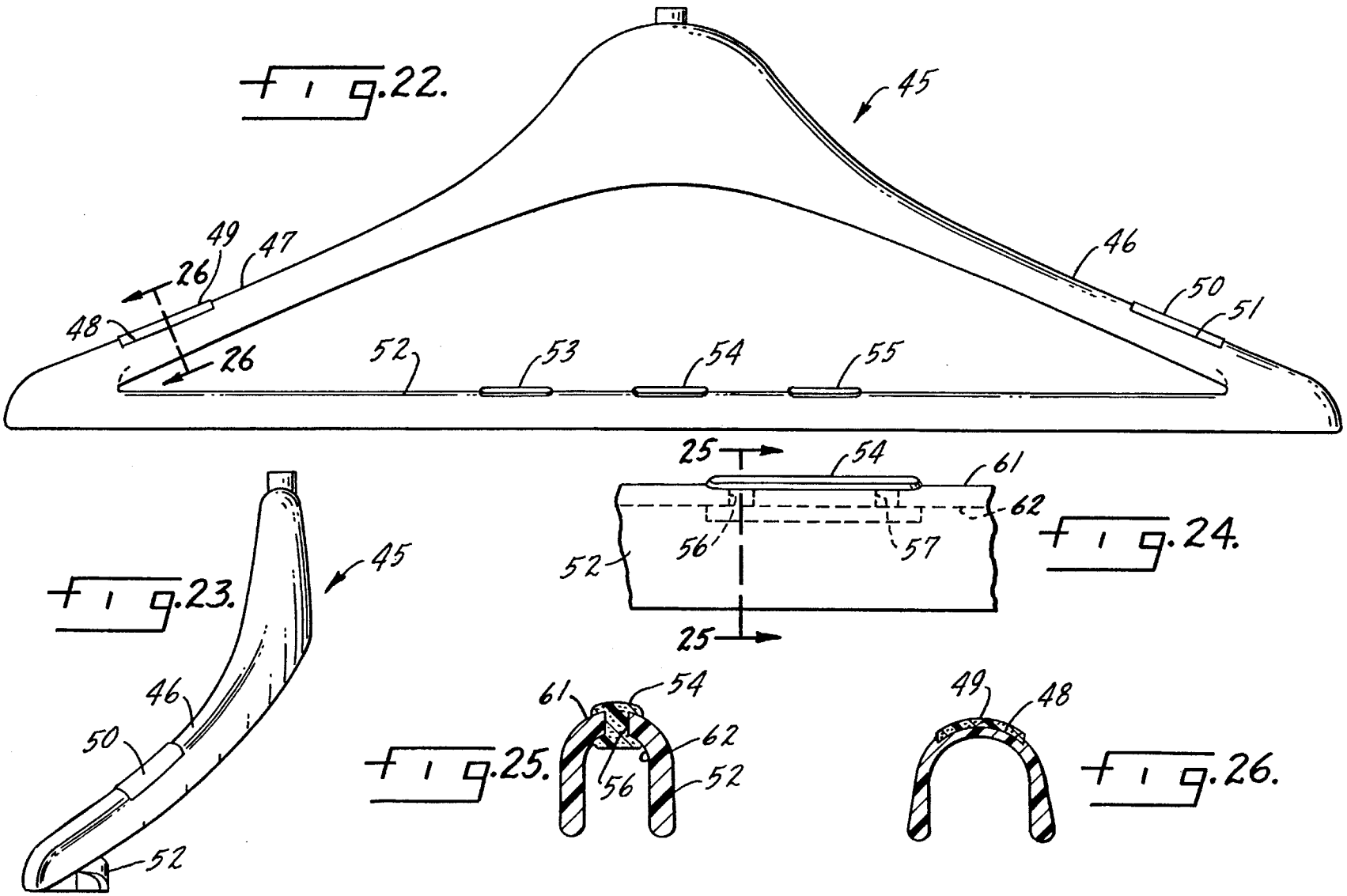
FIG. 22 is a yet another embodiment of a garment hanger made in accordance with this invention, in this instance, providing a pant hanger.
FIG. 23 is a right side view of the hanger depicted in FIG. 22.
FIG. 24 is an expanded view of the resilient pad shown in FIG. 22.
FIG. 25 is a section to an enlarged scale taken substantially along line 25—25 of FIG. 24.
FIG. 26 is a section to an enlarged scale taken substantially along line 26—26 of FIG. 22.

FIG. 22 illustrates a different arrangement for applying the resilient material to a contoured garment coat/pant hanger 45. Shoulder section 47 includes a groove or recess 48 (see FIG. 26) and a coating of resilient material 49 is laid therein. Similarly, shoulder section 46 includes a groove 51 filled with resilient material 50. The pant bar 52 includes three pairs of slots 56 and 57 (see FIG. 24) so that resilient pads 53, 54 and 55 may be plug molded onto pant bar 52. One set of such slots is illustrated in FIG. 24 at 56 and 57. A sectional view of the plug molded pad is illustrated in FIG.

25. In this construction, the need for separate securement means, and the added time during the manufacturing process to add the securement means is eliminated, the structural interlock ensuring adherence of the resilient material to the pant bar.

The resilient friction materials best suited for frictionally engaging a garment onto a garment hanger are block copolymers having discreet block segments of styrene monomer units and rubber monomer units. These materials have the common quality of providing a high coefficient of friction with slippery clothing materials such as silk, rayon and polyester. This family of block copolymers generally breaks down into two types: polymers which include unsaturated rubber monomer units and polymers which include saturated rubber monomer units.

Specific examples of polymers employing unsaturated rubber monomer units include the most common structure which is linear (A-B-A type). These polymers include styrene-butadiene-styrene (S-B-S) and styrene-isoprene-styrene (S-I-S).

The other subcategory of acceptable resilient frictional materials incorporate saturated rubber monomer units. Those compounds include linear styrene-ethylene/butylene-styrene (S-EB-S). In addition to the linear (A-B-A) polymers, there are specialized polymers of the radial $(A\text{-}B)_n$ type. Those polymers include $(\text{styrene-butadiene})_n$, $(S\text{-}B)_n$, or $(\text{styrene-isoprene})_n$, $(S\text{-}I)_n$. Further, polymers of the diblock (A-B) type have been found acceptable. Those polymers include styrene-butadiene (S-B), styrene-ethylene/propylene (S-EP), and styrene-ethylene/butylene (S-EB). Each block segment of the above-mentioned polymers may be 100 monomer units or more.

The preferred resilient friction materials discussed are commercially available from the Shell Chemical Company of Woodstock, Illinois. Specific grades of the preferred resilient material that are usable are G-2706, G-7705, D-3226 and D-2109.

Although preferred embodiments of the present invention have been illustrated and described, it will at once be apparent to those skilled in the art that variations may be made within the spirit and scope of the invention. Accordingly, it is intended that the scope of the invention be limited solely by the scope of the hereafter appended claims and not by the specific words in the foregoing description.

I claim:

1. A method for fabricating an improved garment hanger of the type in which an arcuate garment support member is arranged to receive and suspend a garment in contact with an upper face of the garment support member, the method comprising:

providing a garment support member, the garment support member including a hang means located at about the center of the garment support member, the garment support member including two rows of upwardly protruding cleats, one row of cleats on either side of the hang means and extending from about the hang means to a distal end of the garment support member, each upwardly protruding cleat including an upwardly protruding nipple-like projection at about the center of each upwardly protruding cleat, coating at least a portion of at least one row of upwardly protruding cleats with a resilient friction material including a block copolymer having alternating block segments of styrene monomer units and rubber monomer units thereby providing a non-slip surface to receive the garment and help prevent the garment from falling off the garment hanger.

2. A method for fabricating an improved garment hanger of the type in which an arcuate garment support member is arranged to receive and suspend a garment in contact with an upper face of the garment support member, the method comprising:

providing a garment support member, the garment support member including a hang means located at about the center of the garment support member, the garment support member including two rows of upwardly protruding cleats, one row of cleats on either side of the hang means and extending from about the hang means to about a mid-point between the hang means and a distal end of the garment support member, each upwardly protruding cleat including an upwardly protruding nipple-like projection at about the center of each upwardly protruding cleat, the garment support member including two grooves, one groove on both sides of the hang means, each groove extending from about one mid-point to about a distal end of the garment support member, attaching two strips of resilient friction material, one strip to each groove, the strips of resilient material being in the form of two rows of upwardly protruding cleats with upwardly protruding nipple-like projections at about the center of the upwardly protruding cleats, the resilient friction material including a block copolymer having alternating block segments of styrene monomer units and rubber monomer units thereby providing a non-slip surface to receive the garment and help prevent the garment from falling off the garment hanger.

3. An improved garment hanger of the type in which an arcuate support member is arranged to receive and suspend a garment in contact with an upper surface of the garment support member, the garment hanger comprising:

a garment support member with an upper surface, the garment support member including hang means located at about the center of the garment support member, the upper surface of the garment support member being contoured to receive and support a garment, the upper surface of the garment support member on at least one side of the hang means having a plurality of garment contacting elements of cleat-like configuration which extend upwardly above a base surface on the garment support member, a first portion of the elements on the one side of the hang means being formed from like material and integral with the garment support member, a second portion of the elements on the one side of the hang means having a garment engaging surface formed from resilient friction material, whereby the resilient friction material provides a non-slip surface to help prevent a garment from falling off the garment hanger.

4. The improved garment hanger of claim 3 further characterized in that the resilient friction material comprises a block copolymer having alternating block segments of styrene monomer units and rubber monomer units.

5. An improved garment hanger of the type in which an arcuate support member is arranged to receive and suspend a garment in contact with an upper surface of the garment support member, the garment hanger comprising:

a garment support member with an upper surface, the garment support member including hang means located at about the center of the garment support member, the upper surface of the garment support member being contoured to receive and support a garment, the upper surface of the garment support member on at least one side of the hang means having a plurality of garment contacting elements of cleat-like configuration which extend upwardly above a base surface on the garment support member, a first portion of the elements on the one side of the hang means being formed from like material and integral with the garment support member, a second portion of the elements on the one side of the hang means having a garment engaging surface formed from resilient friction material, the resilient friction material comprises a block copolymer having alternating block segments of styrene monomer units and rubber monomer units, each of the individual elements in the second portion of the elements has an interior portion which generally conforms to, but is slightly smaller than, the configuration of an element in said first portion of the elements, each of the individual elements in the second portion of the elements having the resilient friction material covering an upper surface of the interior portion thereof, whereby the final shape of each of the individual elements in the second portion of the elements is substantially identical in contour to an individual element in the first portion of the elements and the resilient friction material provides a non-slip surface to help prevent a garment from falling off the garment hanger.

6. The improved garment hanger of claim 5 further characterized in that the interior portions of the elements in the second portion project above the base surface.

7. The improved garment hanger of claim 5 further characterized in that each of the individual elements in the second portion of the elements is substantially completely formed from the resilient friction material.

8. The improved garment hanger of claim 7 further characterized in that the individual elements comprising the second portion of the elements are formed as a unitary unit having a common support, the common support being attached to the base surface of the garment support hanger.

9. The improved garment hanger of claim 5 further characterized in that the upper surface of the garment support member on both sides of the hang means have a plurality of garment contacting elements of cleat-like configuration which extend upwardly above a base surface on the garment support hanger, a first portion of said elements on each side of the hang means being formed from like material and integral with the garment support member, and a second portion of the elements on each side of the hang means having a garment engaging surface formed from resilient friction material.

* * * * *